US005489028A

United States Patent [19]

Binder

[11] Patent Number: 5,489,028

[45] Date of Patent: Feb. 6, 1996

[54] METHOD OF REMOVING FOREIGN MATERIAL FROM A ROW OF FIBER BALES AND A BALE OPENING MACHINE THEREFOR

[76] Inventor: Rolf Binder, Schauenbergstrasse 3 CH-8352, Raterschen, Switzerland

[21] Appl. No.: 287,771

[22] Filed: Aug. 9, 1994

[30] Foreign Application Priority Data

Aug. 12, 1993 [CH] Switzerland ..... 02402/93

[51] Int. Cl.[6] ..... B03B 1/00

[52] U.S. Cl. ..... 209/9; 209/587; 414/412

[58] Field of Search ..... 209/9, 287; 414/412

[56] References Cited

U.S. PATENT DOCUMENTS

| | | | |
|---|---|---|---|
| 4,431,530 | 2/1984 | Syben | 209/138 |
| 5,072,490 | 12/1991 | Leifeld et al. | 414/412 X |
| 5,090,864 | 2/1992 | Leifeld | 414/412 |

FOREIGN PATENT DOCUMENTS

| | | |
|---|---|---|
| 0130369 | 1/1985 | European Pat. Off. . |
| 0226430 | 6/1987 | European Pat. Off. . |
| 0412447 | 2/1991 | European Pat. Off. . |
| 3124617 | 1/1983 | Germany . |
| 3320059 | 12/1983 | Germany . |
| 3436498 | 4/1986 | Germany . |
| 3644535 | 7/1988 | Germany . |

*Primary Examiner*—David H. Bollinger
*Attorney, Agent, or Firm*—McAulay Fisher, Nissen, Goldberg & Kiel

[57] ABSTRACT

The bale opening machine is provided with a detection unit upstream of the bale opener for detecting the presence of foreign material at the surface of the fiber bale. In addition, an extraction unit is mounted adjacent the bale opener for removing the detected foreign material from a fiber bale. The extraction unit may include pairs of gripping jaws so as to mechanically remove the fiber material or may be constructed as a suction tube or tubes to pneumatically remove the foreign material. The detection and extraction unit may be mounted on a common side or on opposite sides of the bale opener.

13 Claims, 3 Drawing Sheets

Fig.2
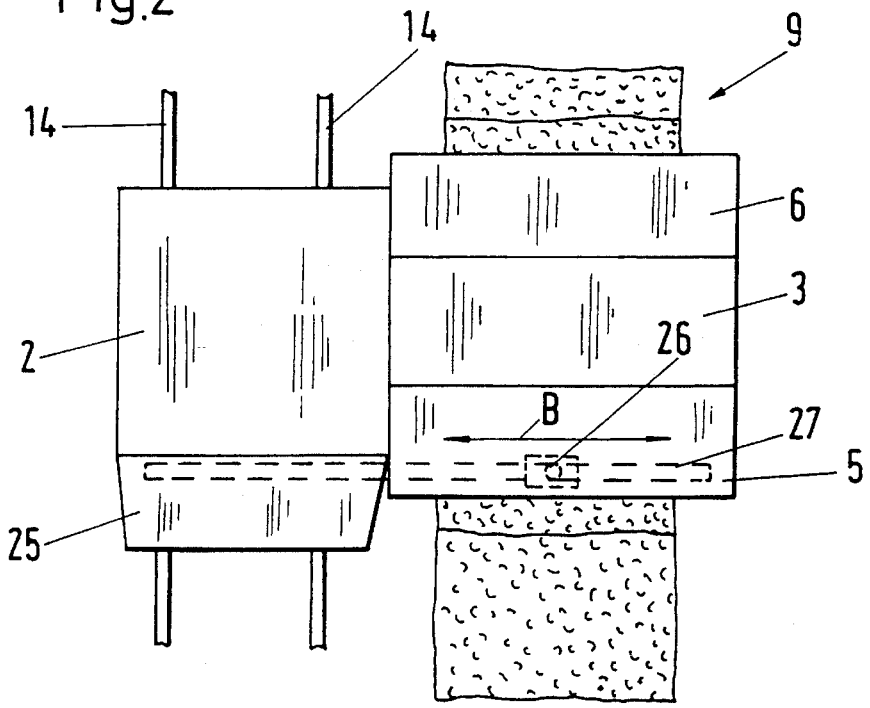
Fig.3
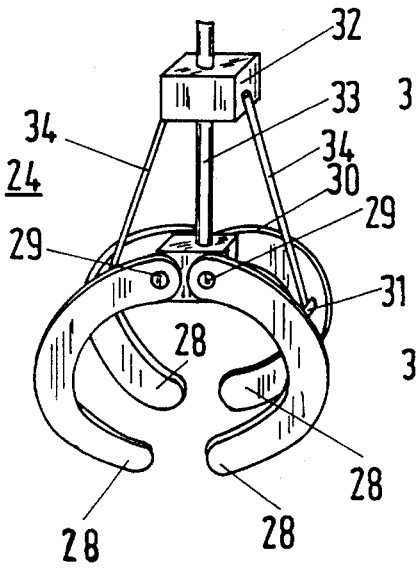
Fig.4
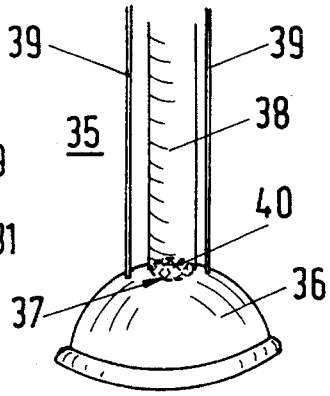
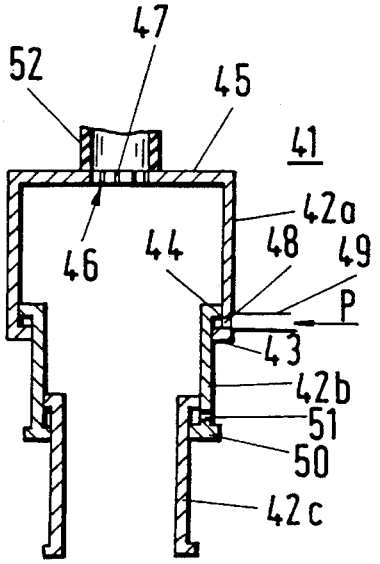
Fig.5

Fig.6a
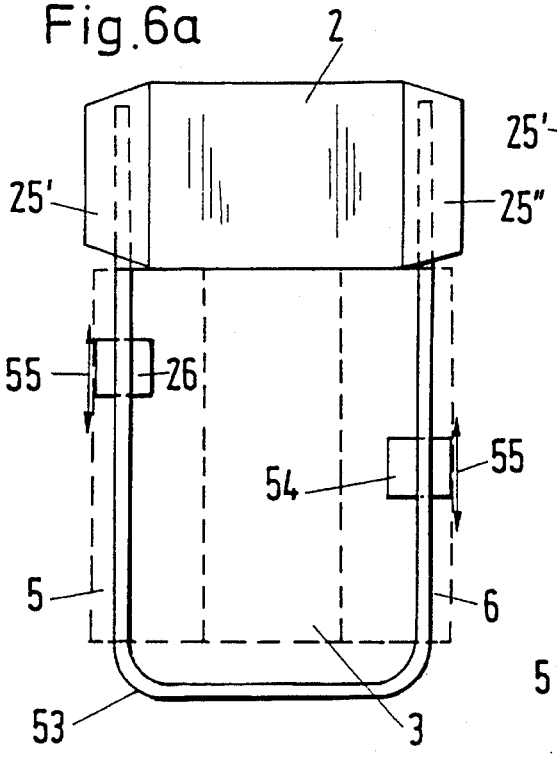
Fig.6b
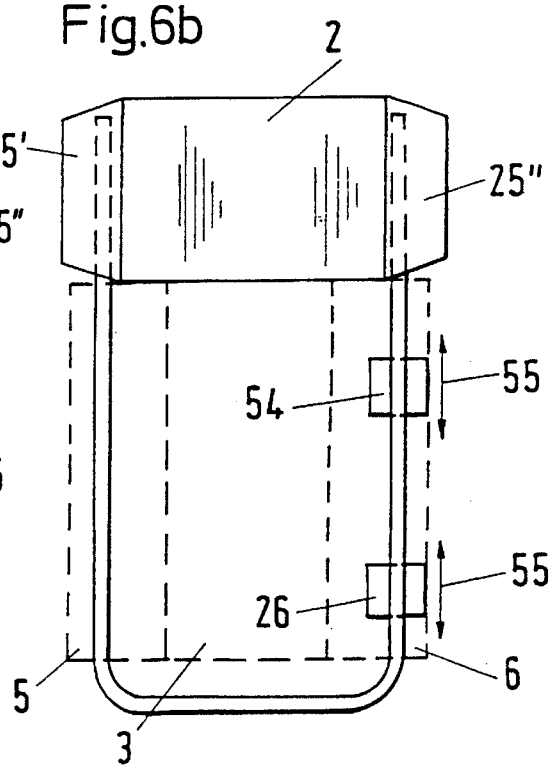
Fig7a
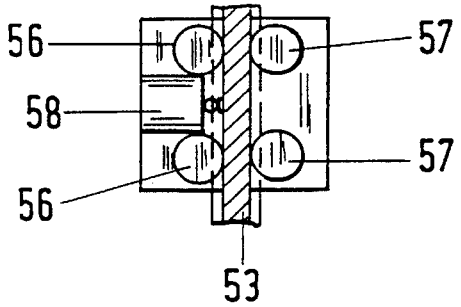
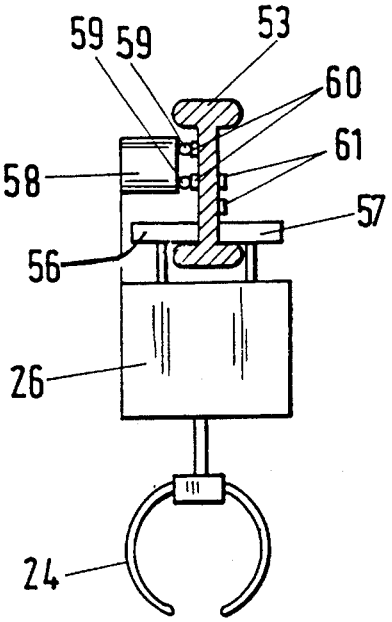
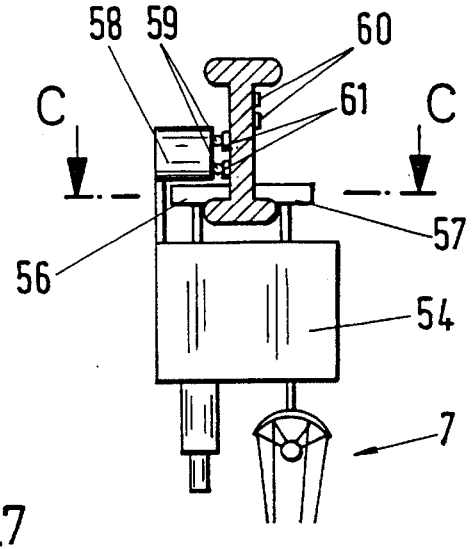
Fig.7

METHOD OF REMOVING FOREIGN MATERIAL FROM A ROW OF FIBER BALES AND A BALE OPENING MACHINE THEREFOR

This invention relates to a method and apparatus for removing foreign material from a row of fiber bales during a bale opening process.

As is known, the problem of contamination in pre-pressed cotton bales has been known for a long time. Such contamination may be in the form of foreign material in the bales such as metal objects like steel straps and wire parts, tools and similar objects or stones and wrapping waste such as jute remains, plastic foil remains, strings or ribbons, rags or cotton cleaning waste. Generally, this type of contamination must be removed from the bales in order to process the fiber removed from the bales. To this end, various suggestions have been made to not only detect the presence of the foreign material but also to remove the foreign material.

For example, DE-A-34 36 498 describes the use of a foreign material detector which is arranged on the side of a row of bales and which moves back and forth together with a bale opener in order to scan the interior of the bales for metal parts. Once a metal part has been located, the bale opener is immediately stopped. An operative can then manually remove the detected metal part from the bale.

DE-A-36 44 535 describes another technique wherein fiber flocks are taken out of the fiber bales and forwarded on a conveyor belt while being checked for foreign material by means of a camera. Once foreign material is detected, the material is removed from the normal fiber strand by means of a tube gate. However, this technique has the disadvantage that, together with the foreign material to be removed, a large portion of quality fiber is also removed at the same time.

Another technique is described in EP-B-01 30 369 wherein a fiber detection means or a swinging gate is arranged above a bale opener. As described, the gate is deflected by larger foreign objects, such as stones, metal parts and the like, thereby inducing a switch to stop the bale opener. In this case, the foreign material has to be removed manually by an operative.

More recent techniques have related to the detection of foreign material in the form of plastic waste, wrapping remains, remains of jute bags, and the like, as well as wooden parts, foreign fibers and similar material such as described in EP-A-0 412 447 or DE-A-39 36 079. In accordance with these techniques, the surface of the bales is scanned with a camera or by other detecting means in order to detect this type of foreign material. The result of the detection is either recorded in a computer or the detected locations are passed by in a controlled manner.

All of the above mentioned techniques offer an automatic detection of foreign material; however, the foreign material must still be removed manually by an operative.

Briefly, the invention provides a method of removing foreign material from a row of fiber bales during a bale opening process. In accordance with this method, a bale opener is moved over a row of fiber bales to remove a layer of fiber from each of the bales. During this time, the presence of foreign material is detected in an upper surface of a fiber bale during movement of the bale opener over the row of bales. In response to the detection of foreign material, an extraction unit is moved over the fiber bale to a position over the detected foreign material in order to remove the detected foreign material.

In one embodiment, the presence of foreign material is detected in advance of the movement of the bale opener. Once the foreign material has been detected, the bale opener is raised to pass over the foreign material in order to permit removal of the foreign material by The extraction unit which follows the bale opener.

In another embodiment, after the foreign material has been detected, the direction of movement of the bale opener is reversed in order to move the bale opener a predetermined distance away from the detected foreign material. The direction of movement of the bale opener is again reversed to again move toward the detected foreign material while the foreign material is removed via the extraction unit.

The extraction unit may be constructed to extract the detected foreign material mechanically and to deposit the extracted material in a waste container. Alternatively, the extraction unit may extract the detected foreign material pneumatically for transfer to a waste container.

The invention also provides a bale opening machine which is comprised of a bale opener for moving across a row of fiber bales to remove layers of fiber from each of the bales, a detection unit mounted adjacent the bale opener to detect the presence of foreign material at an upper surface of a fiber bale and an extraction unit mounted adjacent the bale opener for removing detected foreign material from a fiber bale in the row.

In one embodiment, the detection unit and extraction unit are mounted on a common side of the bale opener relative to the direction of movement of the bale opener over the row of fiber bales. In another embodiment, the detection unit and extraction unit are mounted on opposite sides of the bale opener from each other.

The bale opening machine may also employ a carriage which is movable transversely of the direction of movement of the bale opener along the row of fiber bales in order to carry the extraction unit thereon.

As noted above, the extraction unit may include a gripper for mechanically gripping and removing foreign material from a fiber bale or may include a suction means for pneumatically moving foreign material from a fiber bale.

These and other objects and advantages of the invention will become more apparent from the following detailed description taken in conjunction with the accompanying drawings wherein:

FIG. 2 illustrates a top-view of the bale opening machine of FIG. 1;

FIG. 3 illustrates a perspective view of a gripper for extracting foreign material from a bale in accordance with the invention;

FIG. 4 illustrates a view of a suction means having a suction cup and suction tube for pneumatically removing foreign material in accordance with the invention;

FIG. 5 illustrates a modified suction means employing a plurality of telescopically mounted suction tubes in accordance with the invention;

Figure 1:
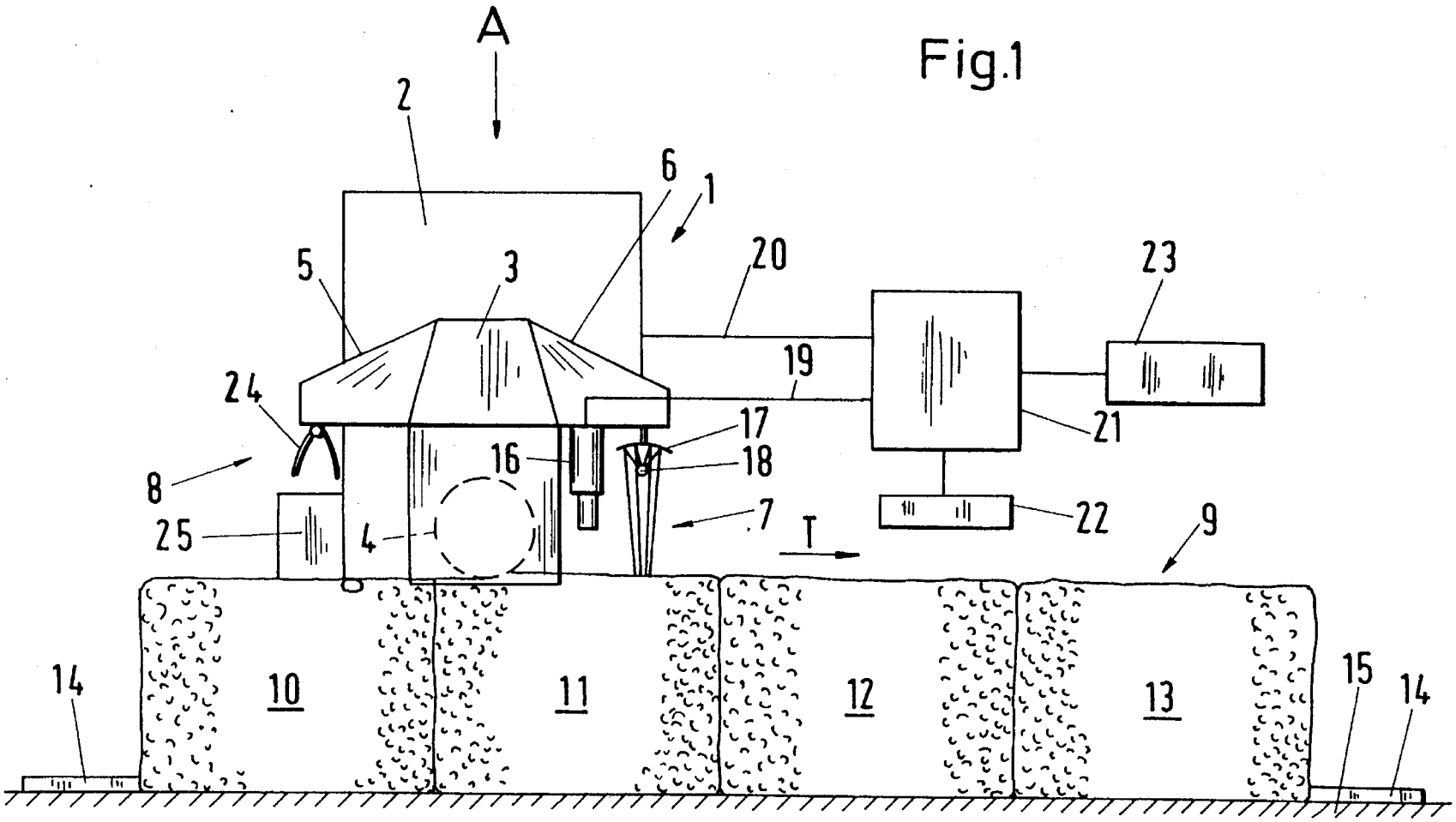
FIG. 1 illustrates a side-view of a bale opening machine constructed in accordance with the invention.

FIG. **6*a*** illustrates a top view of a bale opening machine having an extraction unit and a detection unit mounted on opposite sides of a bale opener;

FIG. **6*b* illustrates a view similar to FIG. 6*a*** of a machine with an extraction unit and detection unit mounted on a common side of the bale opener;

FIG. 7 illustrates a part cross-sectional view of a bale opening machine in accordance with FIG. **6*a*; and FIG. 7*a* illustrates a view taken on line C—C of FIG. 7**.

Referring to FIG. 1, the bale opening machine 1 is constructed with a pivotable head 2 having a protruding support arm 3 in which a conventional bale opener 4 is mounted. Such a bale opening machine is generally known and is distributed by Rieter Spinning Systems under the brand name UNIFLOC.

The bale opening machine 1 is also provided with a pair of additional arms 5, 6 which are provided on opposite sides of the support arm 3. The forward arm 6 houses a detection unit 7 for detecting the presence of foreign material in advance of the bale opener 4 whereas the rear arm 5 mounts an extraction unit 8 for removing detected foreign material.

As shown in FIG. 1, the bale opening machine is constructed so that the bale opener 4 is able to move across a row of fiber bales 9, for example a row of four bales 10, 11, 12, 13. As is known, the bale opener 4 operates to remove a layer of fiber from each of the bales 10–13 in sequence. After making one pass over the bales 10–13, the bale opener 4 may be reversed to strip off another layer from the bales in reverse order or may be returned to a position over the first bale 10 for repeating a cycle.

As indicated, the bale opening machine 1 runs via rollers (not shown) on a pair of guide rails 14 mounted on a floor 15 of a spinning mill.

The detection unit 7 consists of the heat sensing camera 16 and a concave reflector 17 which is provided in its focal line with an infrared rod 18. This camera 16 and the head 2 of the machine 1 are connected with a computer 21 by means of control lines 19, 20. The computer 21 is in turn connected with a keyboard 22 and a printer 23. Further details of this part of the bale opening machine 1 are illustrated exactly and described in FIG. 2 of EP-A-0412447 so that further details need not be further described. Instead of the illustrated detection unit 7, the detection unit may be constructed as illustrated in FIGS. 1 and 3 of EP-A-0412447.

The extraction unit 8 includes a gripper 24 and a waste container 25.

Referring to FIG. 2, the arm 5 houses a guide rail 27 which extends transversely of the direction of movement of the bale opening machine 1 over the row 9 of fiber bales. In addition, the guide rail 27 extends over the waste container 25. A carriage 26 is mounted on the guide rail 27 so as to move transversely of the row of fiber bales and transversely of the waste container 25 in the direction indicated by the arrow B. In addition, the carriage 26 carries the gripper 24 (not shown in FIG. 2). During operation, if foreign material is extracted by the gripper 24 from a fiber bale, the carriage 26 moves over the waste container 25 so that the gripper 24 is able to deposit the foreign material into the waste container 25. Immediately thereafter, the carriage 26 again moves into a waiting position which can, for example, be approximately in the middle of a bale of the row of bales 9.

Generally, the driving speed of the bale opening machine 1 is relatively slow. Thus, the foreign material detected in the bales can be removed with the gripper 24 without stopping the bale opening machine 1. Only if two pieces of foreign material are detected within too short of a distance does the bale opening machine 1 need to be stopped in order that the second or following piece of foreign material can be removed.

Referring the FIG. 3, the gripper 24 may be constructed with four gripping jaws 28 each of which is pivotally mounted via a bolt on a block 30. As indicated, a connecting rod 31 (only one of which is shown) serves to join two adjacent gripping jaws 28 together so that these jaws 28 operate in unison. The gripper 24 also has a second block 32 disposed above the first block 30. In addition, a rod 33 is connected to the lower block 30 and slides through the upper block 32. A pair of cross-rods 34 are also connected pivotally between the upper block 32 and the respective rods 31 on the jaws 28. Thus, the gripper 24 can be operated in the manner of a two-cabled dredger, for example as described on page T15 in the "Dubbel Taschenbuch fur den Maschinenbau", (Machinery Handbook) 16th edition, published by Springer.

FIG. 4 shows an embodiment of an extraction unit consisting of a suction means 35 with a calotte type suction cup 36 provided with a central circular hole 37 for sucking-off. This circular hole 37 is connected with an accordion-type suction tube 38 which is connected to a suction system (not shown) similar to that of a vacuum cleaner, which, for instance can be mounted on the support arm 3 (not shown in detail). By means of two cables 39, for instance made of steel, the suction cup 36 can be moved upwards and downwards. In order to only hold the foreign material but not to draw the foreign material into the suction tube 38 itself, a filter or wire sieve 40 is provided in the opening 37. The suction cup 36 is thus used the same way as the gripper 24, i.e. moved back and forth on a carriage.

FIG. 5 shows another embodiment of a foreign material extraction unit in the form of a telescopic type suction tube 41. This suction tube 41 consists of three hollow cylindrical tubes **42*a*, 42*b* and 42*c*, whereby the diameter of the first (outermost) tube 42*a* is larger than the diameter of the following tube. The upper edge of the middle tube 42*b* is flanged outwards 19 and the inner edge of the upper tube 42*a* is flanged inwards, so that a protruding circular ring 43 of the middle tube 42*b* and a circular ring 44 protruding inward on the upper tube 42*a*, leave a small hollow cylindrical space, which can be enlarged or made smaller, depending on how far the middle tube 42*b* is pushed into the upper tube 42*a*. In a similar way, the lower tube 42*c* is arranged in relation to the middle tube 42*b*** and thus need not be described any further.

The upper side of the upper tube **42*a* ends with a cover 45 which has a central opening communicating via a coarse sieve 47 with a flexible hose 52. The lower end of the upper tube 42*a* is provided with a small hole 48 which is connected by means of a hose 49 to a pressure source, indicated with an arrow P. If this hole 48 receives compressed air, the hollow cylindrical space between the tubes 42*a* and 42*b* is increased, thus moving the tube 42*b* upwards. The tube 42*b* moves upwards until the ring 50 at the lower of the tube 42*b* stops the movement. Then a further hole 51 in the lower side of the tube 42*b* communicates with the hole 48, so that tube 42*c* is also moved upwards by the compressed air. In this embodiment, it is important that there is always a small hollow cylindrical space between the tubes 42*a* and 42*b*, and the tubes 42*b* and 42*c*. This can be achieved through suitable measures such as a milled recess or similar. With the flexible hose 52, the suction tube 41** is connected to a suction means (subpressure) of the type such as a vacuum cleaner.

Referring to FIG. **6*a*, wherein like reference characters indicate like parts as above, the bale opening machine may be provided with a U-shaped guide rail 53 which is housed in the support arms 5, 6 and which extend over waste containers 25', 25". In this embodiment, a carriage 26 is movable along the guide 53 to one side of the bale opener (support arm 3) to carry an extraction unit (not shown). A further carriage 54 is provided on the opposite side of the bale opener support arm 3 for movement along the guide rail 53. This carriage 54 serves to carry the detection unit (not shown). The back and forth movement of the carriages 26, 54 across the entire width of the bale is indicated by double arrows 55. The guide rail 53 is itself suspended in a known manner below the two arms 5, 6 and thus surrounds the support arm 3 for the bale opener. The guide rail 53 extends at the two ends to the rear side of the head 2 so that the carriage 26 can move over the laterally-attached waste containers 25'** in order to deposit extracted foreign material.

Referring to FIG. 6*b*, wherein like reference characters indicate like parts as above, the carriages 26, 54 may be mounted on a common side of the bale opening machine relative to the bale opener support arm 3. Thus, the two carriages 26, 54 perform their backward and forward movement on the same side of the support arm 3. In this case, the carriage 26 moves over the waste container 25" in order to deposit foreign material therein.

Referring to FIGS. 7 and 7*a*, wherein like reference characters indicate like parts as above, the carriage 26 for the gripper 24 of the extraction unit is mounted on the guide rail 53 in a suspended manner via a pair of driven rolls 56 and a pair of free running rolls 57. In addition, a collector 58 is mounted between the driven rolls 56 and is provided with contacts 59 which have a sliding contact with strips 60 arranged on one side of the guide rail 53 for current collection. This collector 58 serves to supply power for the motors and the transfer of control signals for the driven rollers 56 and for the gripper 24. A pair of strips 61 are provided on the opposite side of the guide rail 53 to make sliding contact with contacts 59 of a second collector 58 which is provided for operating the carriage 54 for the foreign material detection unit 7.

With the specific arrangement as shown in FIG. 6*a*, the bale opening machine may operate in both directions of movement relative to the row of fiber bales. In this respect, the opener 4 may operate in both directions and, at the same time, can engage in the functions of detection of foreign material and extraction of foreign material in both moving directions.

If the bale opening machine 1 according to FIG. 6*a* moves towards the right, foreign material possibly being at the surface of the bale is detected by the back and forth moving foreign material detection unit 7 on the carriage 54. Based on the moving speed of the bale opening machine 1, a determination can be made as to when the opener 4 will reach the foreign material. Shortly before reaching the point where the foreign material is located, the support arm 3 is lifted and then lowered again after this point, so that this part of the bale is purposely left out or "jumped over". Meanwhile, the carriage 26 of the foreign material extraction unit 8 has been moved to the right position, so that the gripper 24 (or the suction means 35 or the section tube 41—FIG. 3 to 5) can remove the foreign material. Then, either the bale opening machine 1 is moved back so far that the omitted "strip" (not worked-off layer portion) is also removed, or the bale opening machine 1 simply moves on and seizes this "strip" together with the next opening step (at the return move).

If the foreign material was not successfully removed the first time, a second attempt is started. Depending on how the processes are programmed in the computer 21 (FIG. 1), the bale opening machine 1 is switched off after a preset number of unsuccessful attempts and a signal (flashing light or similar) calls for the operatives.

In the embodiment according to FIG. 6*b*, the carriage 26 for the foreign material extraction unit (gripper 24, suction means 35 or suction tube 41) and the carriage 54 for the foreign material detection unit are arranged on the same side of the support arm 3. In this case, the carriage 26 is in a waiting position outside the width of the bales and the carriage 54 slowly moves back and forth at certain intervals. If foreign material is detected, the bale opening machine 1 stops, drives back a certain distance on its moving path and the foreign material is removed by the gripper 24. After successful removal, the bale opening machine 1 then moves on in normal operation whereby over a certain period, a slower start can be considered, so that the foreign material detection unit, after locating foreign material, can immediately operate at full capacity. It is of course understood that such processes are contained in a program in the computer 21.

With the two embodiments of FIGS. 6*a* and 6*b*, a foreign material detection and a foreign material extraction is assured during the back and forth movement of the bale opening machine 1 over the rows of bales 9.

The foreign material detection unit 7 may alternatively be constructed such as disclosed in DE-A-3436498 in order to carry out the functions according to the above description. An important factor is the localization of foreign material near the bale surface of a respective bale so that the extraction unit 8, in controlled movement, can be aimed at the location of the foreign material.

The invention thus provides a relatively simple technique for not only detecting the presence of foreign material in a fiber bale but also a relatively simply technique for readily removing the detected foreign material.

Still further, the invention provides a bale opening machine which is able to automatically detect and remove foreign material from a fiber bale without loss of any significant amount of quality fiber.

The invention offers a major advantage in that an automatic detection of foreign material and an automatic extraction of foreign material can be performed by means of economical measures. This allows for automated operation during bale opening without supervision by operatives. This easily facilitates night shifts without the presence of operatives so that the rate of efficiency of the machines can be considerably increased.

What is claimed is:

1. A method of removing foreign material from a row of fiber bales during a bale opening process, said method comprising the steps of moving a bale opener over the row of fiber bales to automatically remove a layer of fiber from each of the bales;

detecting the presence of foreign material in an upper surface of a fiber bale in the row of fiber bales during movement of the bale opener over said row; and thereafter moving an extraction unit over the fiber bale to a position over the detected foreign material to remove the detected foreign material.

2. A method as set forth in claim 1 wherein the presence of foreign material is detected in advance of the movement of the bale opener and which further comprises the steps of raising the bale opener in response to the detection of fiber material to pass over the foreign material to permit removal of the foreign material by said extraction unit.

3. A method as set forth in claim 1 wherein the presence of foreign material is detected in advance of the movement of the bale opener and which further comprises the steps of reversing the direction of movement of the bale opener to move the bale opener a predetermined distance away from the detected foreign material, and again reversing the direction of movement of the bale opener to move toward the detected foreign material while removing the foreign material via said extraction unit.

4. A method as set forth in claim 1 wherein the extraction unit extracts the detected foreign material mechanically and deposits the extracted material in a waste container.

5. A method as set forth in claim 1 wherein the extraction unit extracts the detected foreign material pneumatically for transfer to a waste container.

6. A method as set forth in claim 1 wherein the extraction unit is positioned and lowered relative to the fiber bale in dependence upon the drive speed of the bale opener over the row of fiber bales.

7. A method as set forth in claim 6 wherein the presence of foreign material is detected via a detection unit mounted adjacent the bale opener and wherein the extraction unit is positioned and lowered relative to a fiber bale in dependence upon the position of the detection unit relative to the supper surface of the fiber bale.

8. A bale opening machine comprising a bale opener for moving across a row of fiber bales to remove layers of fiber from each of the bales;

a detection unit mounted adjacent said bale opener to detect the presence of foreign material at an upper surface of a fiber bale in said row; and an extraction unit mounted adjacent said bale opener for removing detected foreign material from a fiber bale in said row.

9. A bale opening machine as set forth in claim 8 wherein said detection unit and said extraction unit are mounted on a common side of said bale opener relative to the direction of movement of said bale opener over the row of fiber bales.

10. A bale opening machine as set forth in claim 8 wherein said detection unit and said extraction unit are mounted on opposite sides of said bale opener from each other.

11. A bale opening machine as set forth in claim 8 which further comprises a carriage movable transversely of the direction of movement of said bale opener along the row of fiber bales, said carriage having said extraction unit mounted thereon.

12. A bale opening machine as set forth in claim 8 wherein said extraction unit includes a gripper for mechanically gripping and removing foreign material from a fiber bale.

13. A bale opening machine as set forth in claim 8 wherein said extraction unit includes a suction means for pneumatically removing foreign material from a fiber bale.

* * * * *